United States Patent [19]

Zijsling

[11] Patent Number: 4,607,711

[45] Date of Patent: Aug. 26, 1986

[54] ROTARY DRILL BIT WITH CUTTING ELEMENTS HAVING A THIN ABRASIVE FRONT LAYER

[75] Inventor: Djurre H. Zijsling, Gd Rijswijk, Netherlands

[73] Assignee: Shell Oil Company, Houston, Tex.

[21] Appl. No.: 706,987

[22] Filed: Feb. 28, 1985

[30] Foreign Application Priority Data

Feb. 29, 1984 [GB] United Kingdom ..... 8405267

[51] Int. Cl.[4] ..... E21B 10/46

[52] U.S. Cl. ..... 175/329; 175/410

[58] Field of Search ..... 175/329, 409–411; 299/90

[56] References Cited

U.S. PATENT DOCUMENTS 3,885,637 5/1975 Veprintsev et al. ..... 175/329

4,396,077 8/1983 Radtke ..... 175/329

FOREIGN PATENT DOCUMENTS 2084219 4/1982 United Kingdom ..... 175/329

*Primary Examiner*—Stephen J. Novosad

*Assistant Examiner*—John F. Letchford

[57] ABSTRACT

The cutting elements of a rotary drill bit comprise a thin front layer of interbonded abrasive particles, such as diamonds, which layer has a thickness less than 0.45 mm.

2 Claims, 5 Drawing Figures

FIG. 2
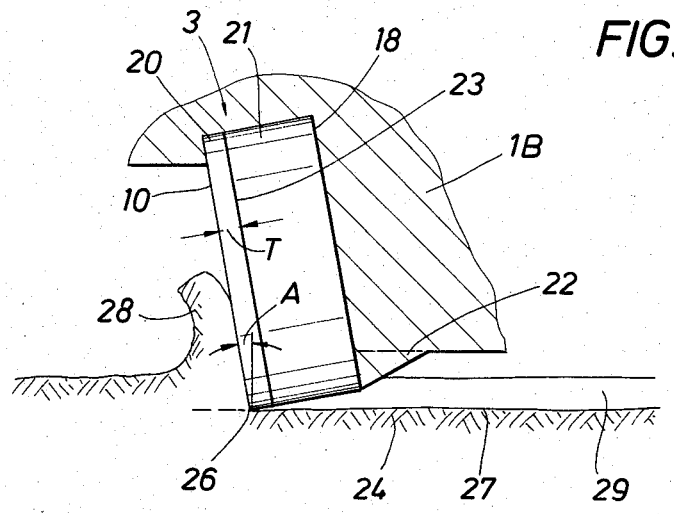
FIG. 3A
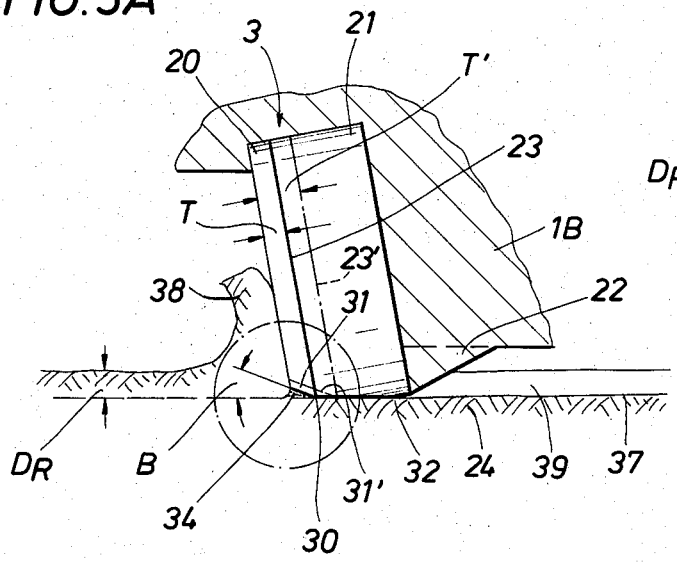
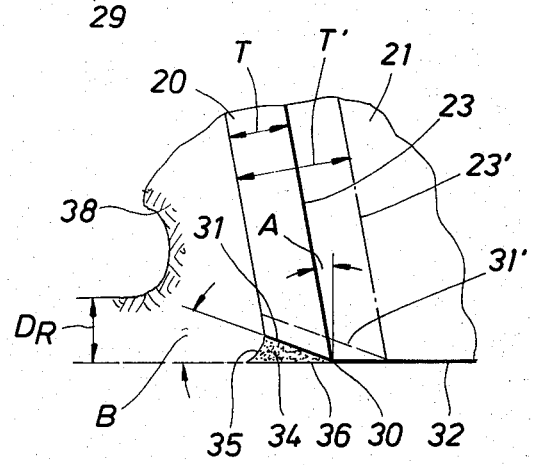
FIG. 3B
FIG. 4
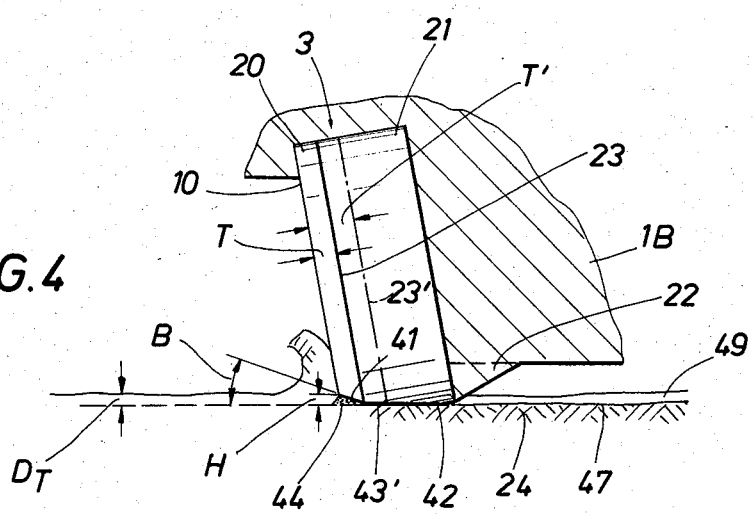

ROTARY DRILL BIT WITH CUTTING ELEMENTS HAVING A THIN ABRASIVE FRONT LAYER

The invention relates to a rotary drill bit for deephole drilling in subsurface earth formations, and in particular to a drill bit including a bit body suitable to be coupled to the lower end of a drill string, the body carrying a plurality of cutting elements, wherein at least part of the cutting elements comprise a front layer of interbonded abrasive particles.

BACKGROUND OF THE INVENTION

Bits of this type are known and disclosed, for example, in U.S. Pat. Nos. 4,098,362 and 4,244,432. The cutting elements of the bits disclosed in these patents are preformed cutters in the form of cylinders that are secured to the bit body either by mounting the elements in recesses in the body or by brazing or soldering each element to a pin which is fitted into a recess in the bit body. During drilling impacts exerted to the cutting elements are severe and in order to accomplish that undue stresses in the elements are avoided the frontal surface of each element is generally oriented at a negative top rake angle between zero and twenty degrees.

The abrasive particles of the front layers of the cutting elements are usually synthetic diamonds or cubic boron nitride particles that are bonded together to a compact polycrystalline mass. The front layer of each cutting element maybe backed by a cemented tungsten carbide substratum to take the thrust imposed on the front layer during drilling. Preformed cutting elements of this type are disclosed in U.S. Pat. No. 4,194,790 and in European Pat. No. 0029187 and they are often indicated as composite compact cutters, or—in case the abrasive particles are diamonds—as polycrystalline diamond compacts (PDC).

During drilling, the cutting elements of a bit run along concentric tracks that overlap each other so that the concentric grooves carried by the various cutting elements in the borehole bottom cause a uniform deepening of the borehole. The elements thereby provide aggressive cutting action to carve the grooves in the bottom and, during drilling, the temperature at the cutting edge of the elements may raise several hundreds degrees Celsius above the formation temperature. The temperature at the cutting edges of this temperature should, in the nowadays applied compact cutters, not exceed 750° C. Above this temperature the bonds between the abrasive particles are weakened to an undue extend so that the particles can easily be pulled out from the matrix, thereby causing an excessive increase in bit wear.

Detailed inspection of field worn drill bits revealed that the abrasive front layers of the cutting elements show wear at the cutting edge only. This wear mechanism has an almost steady state nature since in general the front layers appear to be worn in such a manner that the cutting edge thereof attacks the rock at a negative rake angle, generally indicated as the wear-angle, of between 10° and 15° relative to the borehole bottom. The substrate layers backing the front layers of the elements appear to be worn off substantially parallel to the borehole bottom; the flat surface thus formed at the underside of the element is generally indicated as the wear-flat.

As known to those skilled in the art of drilling, the steady state of the rake angle at the cutting edge is a consequence of shaped body of crushed rock between the toe of the cutting element, the virgin formation and the chip being scraped therefrom. This body of crushed or even plastic rock, called the build-up edge, is of major importance to the drilling performance of the cutting element. This can be illustrated by the fact that under similar drilling conditions (i.e., identical speed of rotation and penetration rate) the drill cuttings in the return mud flow of a worn drill bit are upset to a greater extend than the drill cuttings of fresh bit. The increased upsetting of the drill cuttings is a consequence of the presence of the build-up edge at the toe of a worn cutting element. The contact surfaces between the build-up edge, the chip and the virgin formation, at which surfaces rock to rock contact occurs, form areas of extremely high friction at which a large amount of frictional heat is generated during drilling.

Moreover it appeared that in field worn bits that had been driven by a rotating drill spring at a speed of rotation of typically one hundred revolutions per minute, the front layers of the elements were worn away at the toe thereof in such manner that the cutting edge is located at the interface between the front layer and the substratum. The cutting elements of field worn bits that had been driven by a down-hole turbine at a relatively high speed of rotation of typically about eight hundred revolutions per minute appeared to be worn away in such a manner that the cutting edge thereof is located at about 0.3 mm behind the frontal surface of the front layer.

The cutting elements of these field worn bits were provided as usual, with an abrasive front layer having a thickness of about 0.6 mm. Hence the cutting edge of a cutting element of such a field worn turbine driven bit is located about halfway between the frontal surface of the front layer and the interface between the front layer and substratum, which implies that, during turbine drilling, the section of the lower surface of the front layer behind the cutting edge forms part of the wear-flat. As friction between the abrasive particles of the front layer and the rock formation is high in comparison to friction between the lower surface of the substratum and the rock formation, an excessive amount of frictional heat is generated during turbine drilling at the section of lower surface of the front layer behind the cutting edge.

SUMMARY OF THE INVENTION

The invention aims to provide a drill bit in which, in particular during turbine drilling, the cutting elements are heated up to a lower extent than the cutting elements of the known rotary drill bits under similar drilling conditions. The invention aims moreover to provide a drill bit in which, in particular during drilling operations where the drill bit is driven by a rotating drill string, the magnitude of the build-up edge, which is formed during drilling in front of the cutting edge of each cutting element, remains small in comparison to the build-up edge being formed in front of the cutting elements of the known rotary drill bits under similar drilling conditions.

In accordance with the invention these objects are accomplished by a rotary drill bit comprising a bit body suitable to be coupled to the lower end of a drill string, the bit body carrying a plurality of cutting elements, wherein at least part of the elements comprise a front layer of interbonded abrasive particles having a thickness less than 0.45 mm.

In a suitable embodiment of the invention the thickness of the front layers is between 0.2 and 0.4 mm.

BRIEF DESCRIPTION OF THE DRAWING

The invention will now be explained in more detail by way of example with reference to the accompanying drawing.

FIG. 2 shows the drilling performance of one of the cutting elements of the bit of FIG. 1, taken in cross section along line II—II of FIG. 1.

FIG. 3A shows the drilling performance of the cutting element of FIG. 2 in worn condition during drilling operations wherein the bit is driven by a rotating drill string.

FIG. 3B shows in detail the encircled portion of the worn cutting element shown in FIG. 3A.

FIG. 4 shows the drilling performance of the cutting element of FIG. 2 in worn condition during turbine drilling.

DESCRIPTION OF A PREFERRED EMBODIMENT

Figure 1:
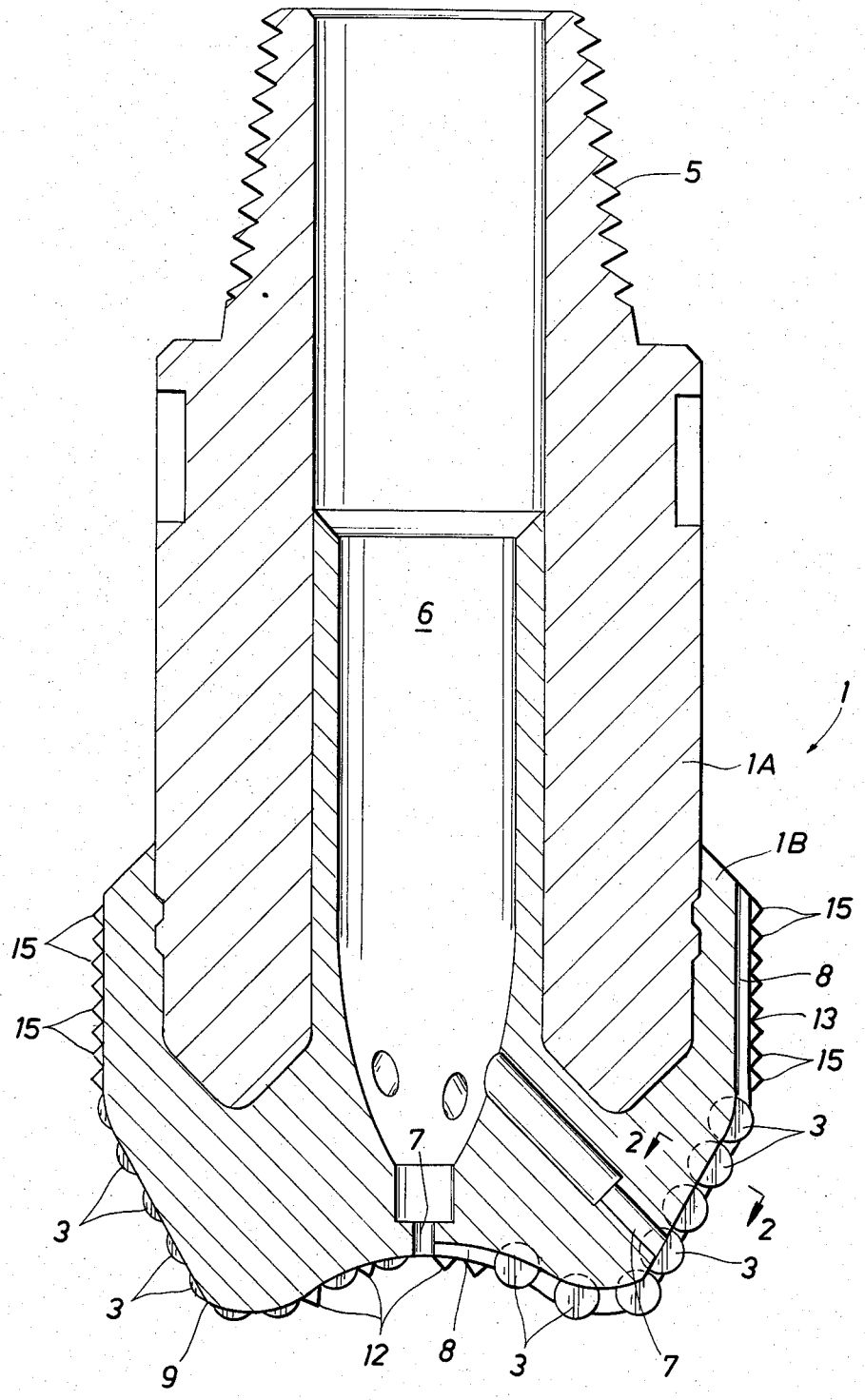
FIG. 1 is a vertical section of a rotary drill bit embodying the invention.

The rotary drill bit shown in FIG. 1 comprises a bit body 1 consisting of a steel shank 1A and a hard metal matrix 1B in which a plurality of preformed cylindrical cutting elements 3 are inserted.

The shank 1A is at the upper end thereof provided with a screw thread coupling for coupling the bit to the lower end of a drill string (not shown). The bit body 1 comprises a central bore 6 for allowing drilling mud to flow from the interior of the drill string via a series of nozzles 7 into radial flow channels 8 that are formed in the bit face 9 in front of the cutting elements 3 to allow the mud to cool the elements 3 and to flush drill cuttings upwards into the surrounding annulus.

The cutting elements 3 are arranged in radial arrays such that the frontal surfaces 10 (see FIG. 2) thereof are flush to one of the side walls of the flow channels 8. The radial arrays of cutting elements are angularly spaced about the bit face 9 and in each array the cutting elements 3 are arranged in a staggered overlapping arrangement with respect of the elements 3 in adjacent arrays so that the grooves being carved during drilling by the various cutting elements 3 into the borehole bottom effectuate a uniform deepening of the hole.

The bit comprises besides the cylindrical cutting elements 3 a series of surface set massive diamond cutters 12, which are embedded in the portion of the matrix 1B near the centre of rotation of the bit. At the gage 13 of the bit a series of massive diamond reaming elements 15 are inserted in the matrix which are intended to cut out the borehole at the proper diameter and to stabilize the bit in the borehole during drilling.

As illustrated in FIGS. 2–4 each cylindrical cutting element 3 is fitting by brazing or soldering into a preformed recess 18 in the matrix 1B. The cylindrical cutting element 3 shown in these figures consists of a thin front layer 20 consisting of a polycrystalline mass of abrasive particles, such as synthetic diamonds or cubic boron nitride particles, and a tungsten carbide substratum 21. The cutting element 3 is backed by a support fin 22 protruding from the matrix 1B to take the thrust imposed on the element 3 during drilling.

In FIG. 2 there is shown the cutting performance of the cutting element 3 in fresh condition. The thickness T of the abrasive front layer 20 is less than 0.45 mm and the element attacks the virgin formation 24 at a negative rake angle of about ten degrees relative to the vertical, which angle is identical to the top rake angle A of the frontal surface 10 of the element 3.

The predetermined amount of weight on bit being applied during drilling exerts a vertical force to the element 3 thereby forcing the toe 26 of the element 3 to penetrate into the rock formation 24. The torque being applied simultaneously therewith to the bit via the drill string (not shown) causes the element 3 to rotate about the centre of rotation of the bit, thereby cutting a circular groove 29 in the rock formation 24 and scraping a chip 28 therefrom.

The chip 28 being removed from the formation 24 by the cutting element 3 is subject to a combination of high compression and shear forces that cause the chip 28 to curl up and to flow in upward direction along the frontal surface 10 of the element 3. The deformation of the chip 28 and friction between the chip 28 and the frontal surface 10 of the element 3 generate a considerable amount of heat. Part of the heat is transferred into the cutting element 3 via the contact surface with the chip 28, which causes the element 3 to heat up during drilling. The downward force applied to the bit during drilling causes the toe 26 of the element 3 to scrape over the bottom 27 of the groove 29 which causes the element 3 to heat up at the toe 26 thereof to a greater extent than at any other location. The large impacts exerted to the toe 26 in combination with the high temperature cause the cutting element 3 to wear-off much faster at the toe 26 thereof than at the frontal surface 10.

In FIG. 3A the cutting performance of the same cutting element as shown in FIG. 2 is illustrated, but now in worn condition.

The wear pattern shown in FIG. 3A occurs in the situation that the drill bit is driven by a rotating drill string to rotate at a speed of rotation of typically one hundred revolutions per minute. This way of drilling, wherein the drill string is driven by a rotary table at the drilling floor, is usually indicated as "rotary drilling". Due to the rather high weight on bit applied during rotary drilling operations, the average depth $D_r$ of the groove 39 being cut is, even in hard rock formations, more than 0.3 mm. In this situation the front layer 20 has been worn off at the toe thereof in such a manner that the cutting edge 30 at which the element 3 attacks the rock formation 24 is located at the interface 23 between the front layer 20 and substratum 21. In front of the cutting edge 30 a slanting surface 31 has been formed, which surface 31 is oriented at a negative rake angle B of between 10° and 15° relative to the bottom 37 of the groove 39 being cut in the formation 24.

The tungsten carbide substratum 21, which has a much lower hardness and wear-resistance than the front layer 20, has been worn away at the contact surface with the formation 24 in such a manner that the worn surface formed in use, called the wear flat 32, is substantially parallel to the bottom 37 of the groove 39.

As shown in detail in FIG. 3B a triangularly shaped body of crushed rock, called the build-up edge 34, is present between the slanting surface 31, the groove bottom 37 and the chip 38 being removed from the formation 24. The build-up edge 34 is compressed to a high extent and in particular the contact surface between the front side 35 of the build-up edge 34 and the chip 38, and this contact surface between the lower side 36 of the build-up edge 34 and the groove bottom 37, at which contact surfaces rock to rock contact occurs, form areas of extremely high friction.

One purpose of providing the cutting element with a very thin abrasive front layer 20 is to reduce during rotary drilling the length of the "high friction areas" at the frontal and lower side 35 and 36, respectively, of the build-up edge 34 in order to reduce the amount of heat generated during drilling at these areas and to improve the chip flow along the frontal side 35 of the build-up edge 34.

As indicated in FIGS. 3A and 3B the thickness T of the abrasive front layer 20 of the cutting elements 3 in the bit according to the invention, which thickness T is less than 0.45 mm, is small in comparison to the thickness T' of the abrasive front layer of the cutting elements in a prior art bit, which thickness T' is about 0.6 mm. The interface 23, between the front layer and substratum of the prior art cutting element and the slanting surface 31' formed in use at the toe of the prior art cutting element, are indicated in phantom lines. The length of the slanting surface 31' formed in use at the toe of the prior art element equals T'/sin (90°-B-A), whereas the length of the slanting surface 31 formed in use at the toe of the element 3 according to the invention equals T/sin (90°-B-A). It is observed that the magnitude of the angle B appears to be permanently between 10° and 15°, irrespective of the thickness T of the front layer 20, and that, therefore, the angle B can be considered to be a constant factor. As, in the situation shown, the top rake angle A is also a constant, the conclusion is to be drawn that in this situation the length of the slanting surface 31, and also the lengths of the high friction areas at the lower and frontal side 35, 36 of the build-up edge 34, are about proportional to the thickness T of the abrasive front layer 20. Resuming it can be stated that due to the reduced thickness T of the front layer 20 in the element of the invention a corresponding reduction of the length of the high friction areas at the lower and frontal sides 35, 36 of the build-up edge 34 is accomplished, provided that the cutting edge 30 is located at the interface 23 between the front layer 20 and the substratum 21 as is the case during rotary drilling.

FIG. 4 shows the cutting performance of the cutting element 3 in the situation that the element 3 has been worn off during use in turbine drilling operations. During turbine drilling the bit is driven to rotate at a speed of rotation of typically eight hundred revolutions per minute by a down-hole turbine (not shown) forming part of the drill string.

During turbine drilling operations in hard formations the cutting depth $D^T$ of the groove being cut per revolution by each cutting element 3 of the bit is usually in the order of 0.07 mm. Detailed inspection of the cutting elements of field worn turbine driven bits revealed that even if each cutting element is provided with a front layer having a thickness T' of about 0.6 mm, the cutting edge 40 is located at about 0.3 mm behind the frontal surface 10. The slanting surface 41 being formed in use at the toe of each cutting element appears to be oriented again at an angle B of between 10° and 15° relative to the bottom 47 of the groove 49. The small distance between the cutting edge 40 and the frontal surface 10° is apparently a consequence of the permanently low magnitude of the build-up edge 44 during turbine drilling operations. It is believed that the low magnitude of the build-up edge 44 during turbine drilling is a consequence of the fact that the height H of the build-up edge 44 does not exceed the depth $D^T$ of the groove 49 being cut in the formation 24.

In the prior art cutting element the section 43' of the lower surface of the front layer located between the cutting edge 40 and the interface 23' between the front layer and substratum forms part of the wear flat 42 formed in use.

Due to the extreme hardness and wear resistance of the front layer 20 friction between the section 43' and the bottom 47 of the groove 49 is high in comparison to the friction between the lower surface of the relatively soft tungsten carbide substratum 21 and the groove bottom 47. Consequently in the prior art element an excessive amount of frictional heat is generated at the section 43', which causes the cutting element to heat up during turbine drilling in the area of the section 43'.

As in the drill bit according to the invention the thickness T of the front layer 20 of the cutting element is less than 0.45 mm the cutting edge 40 is located close to the interface between the front layer 20 and substratum 21. Hence a substantial reduction is achieved of the amount of heat generated at the wear flat 42 during turbine drilling.

To avoid that the wear-resistance of the cutting elements is reduced to an undue extent, it is preferred to provide the drill bit according to the invention with cutting elements having a front layer with a thickness T of more than 0.1 mm. In an attractive embodiment of the invention the thickness of the front layer of each cutting element is between 0.2 and 0.4 mm.

It is observed that instead of the cylindrical shape of the cutting elements shown in the drawing the cutting elements of the bit according to the invention may have any other suitable shape, provided that the cutting elements are provided with an abrasive front layer having thickness less than 0.45 mm. It will be further appreciated that the cutting element may consist of a front layer only, which front layer is sintered directly to the hard metal bit body. Furthermore, it will be understood that instead of the particular distribution of the cutting elements along the bit face shown in FIG. 1 the cutting elements may be distributed in other patterns along the bit face as well.

I claim:

1. Rotary drill bit for deephole drilling in subsurface earth formations, the bit comprising a bit body suitable to be coupled to the lower end of a drill string, the bit body carrying a plurality of cutting elements, said cutting elements facing forwardly in the direction of rotation and extending downwardly from the bit body during normal drilling operations with the cutting face of each cutting element sloping at an angle of within 15 degrees to the vertical, at least part of each of said elements comprising a front layer of interbonded abrasive particles having a thickness of between 0.2 and 0.4 mm., said abrasive particles comprising a polycrystalline mass of abrasive diamond particles said mass being bonded to a tungsten carbide substratum.

2. Rotary drill bit for deephole drilling in subsurface earth formations, the bit comprising a bit body suitable to be coupled to the lower end of a drill string, the bit body carrying a plurality of cutting elements, said cutting elements facing forwardly in the direction of rotation and extending downwardly from the bit body during normal drilling operations with the cutting face of each cutting element sloping at an angle of within 15 degrees to the vertical, at least part of each of said elements comprising a front layer of interbonded abrasive particles having a thickness of between 0.2 and 0.4 mm., said abrasive particles comprising a polycrystalline mass of abrasive boron nitride particles, said mass being bonded to a tungsten carbide substratum.

* * * * *